US005499642A

United States Patent [19]

Uchino

[11] Patent Number: 5,499,642

[45] Date of Patent: Mar. 19, 1996

[54] WASHING APPARATUS

[75] Inventor: Masahide Uchino, Tokyo, Japan

[73] Assignee: Japan Field Co., Ltd., Tokyo, Japan

[21] Appl. No.: 474,141

[22] Filed: Jun. 7, 1995

Related U.S. Application Data

[63] Continuation of Ser. No. 119,115, filed as PCT/JP93/0076, Jan. 21, 1993, abandoned.

[30] Foreign Application Priority Data

Jan. 22, 1992 [JP] Japan ..... 4-031407

[51] Int. Cl.[6] ..... B08B 3/12; B08B 7/04

[52] U.S. Cl. ..... 134/95.1; 134/105; 134/147; 134/155; 134/184

[58] Field of Search ..... 134/61, 102.1, 134/105, 107, 108, 184, 186, 83, 117, 118, 147, 155, 161, 165, 95.1; 202/170

[56] References Cited

U.S. PATENT DOCUMENTS

| | | | |
|---|---|---|---|
| 1,959,215 | 5/1934 | Owen | 134/165 X |
| 4,471,792 | 9/1984 | Koblenzer | 134/83 |
| 4,558,524 | 12/1985 | Peck et al. | 134/105 X |
| 4,817,652 | 4/1989 | Liu et al. | 134/902 X |
| 4,911,189 | 3/1990 | Halbert | 134/105 X |
| 5,143,103 | 9/1992 | Basso et al. | 134/107 X |
| 5,191,908 | 3/1993 | Hiroe et al. | 134/102.1 X |

FOREIGN PATENT DOCUMENTS

| | | |
|---|---|---|
| 4-009885 | 5/1966 | Japan . |
| 56-024552 | 6/1981 | Japan . |
| 58-058181 | 4/1983 | Japan . |
| 63-024754 | 5/1988 | Japan . |
| 2-003831 | 1/1990 | Japan . |
| 3-047576 | 2/1991 | Japan . |
| 3-019996 | 4/1991 | Japan . |
| 3-238072 | 10/1991 | Japan . |
| 4-037580 | 3/1992 | Japan . |
| 4-087334 | 3/1992 | Japan . |

OTHER PUBLICATIONS

PCT/JP93/00076, International Search Report mailed Apr. 13, 1993.

*Primary Examiner*—Philip R. Coe
*Attorney, Agent, or Firm*—Varndell Legal Group

[57] ABSTRACT

A washing apparatus capable of easily performing washing work of varied types for electronic parts, mechanical parts and medical supplies. In an external bath(1), a vertically movable table(10) for articles to be washed is provided and a covering member(13) is disposed upwardly of the table(10). The articles to be cleaned are tightly sealed by the covering member(13), whereby a washing chamber(14) is formed in the external bath(1). Since the washing chamber(14) is tightly sealed by the covering member(13), incombustible gas is filled up in the external bath(1) when a combustible solvent is used, thus preventing ignition. When vapor washing is performed, the washing can be performed with low energy by use of a heating device provided in the external bath(1). Washing solutions of different types can be used in the external bath(1) and the washing chamber(14).

11 Claims, 3 Drawing Sheets

WASHING APPARATUS

CROSS REFERENCE TO RELATED APPLICATION

This application is a continuation application of International Application No. PCT/JP93/00076, filed Jan. 21, 1993, which entered the U.S. national phase and was assigned U.S. Ser. No. 08/119,115, filed on Sep. 17, 1993, now abandoned.

TECHNICAL FIELD

This invention relates to a washing apparatus capable of readily performing plural kinds of different washing works for articles to be cleaned, such as electronic parts, mechanical parts, medical supplies, and the like, in accordance with the purpose of the washing work.

BACKGROUND ART

There has been known that conventional washing apparatuses perform different washing works, such as immersion washing, vapor washing, and the like, in a single washing bath, as of the inventions described in Japanese Patent Publications No. Hei 3-58,789 and No. Hei 3-551,925.

In these conventional apparatuses, although any of these apparatuses perform liquid washing, vapor washing and the like while conveying articles to be cleaned, the articles are always exposed in a washing bath, so that the articles can not be moved as in a sealed condition separately from the washing bath and can not be washed as in the sealed condition.

Therefore, in the case that the articles are washed with vapor, there is no way to produce vapor in a conventional apparatus except that the entire solvent in the vapor producing bath is heated, so that it needs much more energy than energy to be required for obtaining necessary vapor, thereby resulting in being expensive.

In a conventional ordinary apparatus, it is extremely dangerous to wash the articles with a combustible solvent. Although there is an apparatus capable of washing by the combustible solvent, the apparatus is made to be complicated and large, and therefore, has a weakness in practical use.

In the case that the articles are dried after liquid-washed with a conventional apparatus, in particular, the case when the articles are vacuum-dried, the entire washing bath is sealed, and then, the apparatus does vacuum drying after washing liquid is drained out. After the completion of vacuum drying, the articles are taken out, and washing liquid is filled up into the washing bath again to perform next washing work. Therefore, pouring and draining washing liquid are turned into tedious works, causing inferior workability.

The conventional apparatus described above has a fault that the washing apparatus can not handle liquid washing work and vacuum drying work continuously in the single washing bath.

Moreover, in the case that an apparatus continuously does only the vacuum drying work, it is possible even for the conventional apparatus to apply vacuum drying to the articles already liquid-washed after introducing them in the vacuum drying chamber, where the washing apparatus is formed with a vacuum drying chamber in addition to the washing bath. However, in the case that a solvent is used for washing work, the apparatus raises a problem in which the solvent attached to the articles will diffuse while the articles are transferred to the vacuum drying chamber. In addition, another problem is that the entire mechanism becomes larger and more expensive since the apparatus for vacuum drying must be a separate apparatus.

Furthermore, in order to form a vacuum inside the whole washing bath as done in the conventional apparatus, a much larger volume than a space occupied by the articles, is required in the vacuum, resulting in extremely bad efficiency.

This invention is about to solve the problems described above and facilitates various kinds of different washing works in a single washing bath.

DISCLOSURE OF THE INVENTION

In this invention, an external bath is provided, and a table for articles to be cleaned containable in the external bath is movably disposed in the external bath. The articles on the table can be sealed with a covering member under a condition that the articles are contained in the external bath.

According to this, after the completion of washing by use of washing liquid, the table is moved up to a position at which there is no washing liquid. Then, a top face of the table is sealed and covered with the covering member, and a heating device installed in the external bath heats the table and the covering member from their outer periphery. This heating allows a small quantity of the washing liquid remaining at the table and the covering member to evaporate. The articles can be washed with vapor with less energy due to the evaporation of the heated washing liquid.

In the case that a combustible solvent is employed for washing of the articles, the table having the articles thereon is sealed and covered with the covering member, and then, the washing apparatus performs washing work with the combustible solvent under the sealing condition. At the same time, incombustible gases, such as gas of complete fluoride liquid, nitrogen gas, or the like, filled in the external bath, the washing apparatus can prevent the solvent from igniting. Even in case of igniting, it is possible to extinguish the fire automatically with the incombustible gas in the external bath.

According to the invention, it is possible to wash using different washing liquids for an immersion washing portion and a washing chamber sealed with the covering member, respectively, in the single washing apparatus, so that different washing works, such as primary washing and rinsing, are readily performed therein.

In this invention, the covering member has a connection opening to an external mechanism, which is required for washing. From this constitution, when a vacuum pump is connected to the connection opening through a connecting pipe and made to operate, the articles in the washing chamber composed of the table and the covering member can be vacuum-dried under a condition of which the table is sealed with the covering member.

After the articles on the table are made to contact with the washing liquid, when the table is sealed with the covering member and the washing chamber is depressurized to be a vacuum, the gas contained in the washing liquid in the washing chamber is sucked to be eliminated. By the elimination of the gas from the washing liquid, an ultrasonic vibration can extremely easily transmit across the washing liquid. Therefore, an ultrasonic washing effect by an ultrasonic vibrator arranged at the table is considerably improved, so that extremely highly effective ultrasonic washing can be conducted.

Various benefits can be obtained when the table is covered with the covering member and the articles are vapor-washed under a depressurized condition of the washing chamber.

That is, under an atmosphere of a reduced pressure, even if a combustible solvent, such as hydrocarbonaceous solvent, terpenic solvent, hydrophilic solvent, silicic solvent, or the like, is used as a solvent, since vapor washing is conducted in an extremely thin-air condition, the danger of igniting is extremely low, and vapor washing can be conducted safely.

Where the vapor washing is conducted under the atmosphere of a reduced pressure, the vapor can be generated at a temperature lower than that for generating vapor by boiling a solvent under a normal pressure, so that the articles are vapor-washed at this low evaporation temperature. As a result, even if the articles are made of materials unbearable against a high temperature, the washing apparatus can perform the vapor-washing at a low temperature 100° C. or below using a solvent having its boiling point 100° C. or above. Accordingly, the washing apparatus can freely do the vapor washing of the articles to be cleaned without restrictions from heat-resistant natures of the articles.

In the case that the vapor washing is done under reduced pressure, if supply of washing vapor is stopped after the completion of vapor washing, the atmosphere of the reduced pressure becomes only a depressurized condition at which any vapor does not exist. By this reduced pressure, therefore, the articles evenly heated through the vapor-washing can be vacuum-dried under the reduced pressure, so that the articles are rapidly dried.

According to the invention, the table is formed in a plate shape that does not pass the washing liquid therethrough in a vertical direction. Therefore, since the washing liquid is stirred strongly in the external bath during up and down movements of the table, the table can make contacts between the articles and the washing liquid strong, thereby enabling to obtain an excellent washing effect.

When the table is equipped with an ultrasonic vibrator, ultrasonic washing is conducted at the same time the table is moved up and down in the washing liquid while the articles are strongly contacted with the washing liquid, so that the washing apparatus can obtain a higher washing effect.

When the table is equipped with a rotary mechanism for articles, the articles can be cleaned while rotated, and even for washing of the articles having a recess or recesses, the washing apparatus can surely supply the washing liquid to the recess or recesses. This is also effective for spinning off the liquid after the completion of the immersion washing.

Providing, in the external bath, an immersion washing portion at a lower end, an upper operation chamber on an upper side of the immersion washing portion, and a loading chamber for the articles on an upper side of the upper operation chamber, enables the washing apparatus to perform different washing works such as the immersion washing and vapor washing in a single washing bath thereof.

In addition to washing means as for the immersion washing and vapor washing, the washing apparatus can perform washing by introducing a washing liquid, which is different from the liquid for the immersion washing portion, into the washing chamber sealed by the covering member. That is, it is possible for the washing apparatus to perform a primary washing of the articles at the immersion washing portion and to perform finishing washing or whatever by introducing the different washing liquid into the washing chamber sealed with the covering member in the upper operation chamber.

BEST MODE FOR CARRYING OUT THE INVENTION

Figure 1:
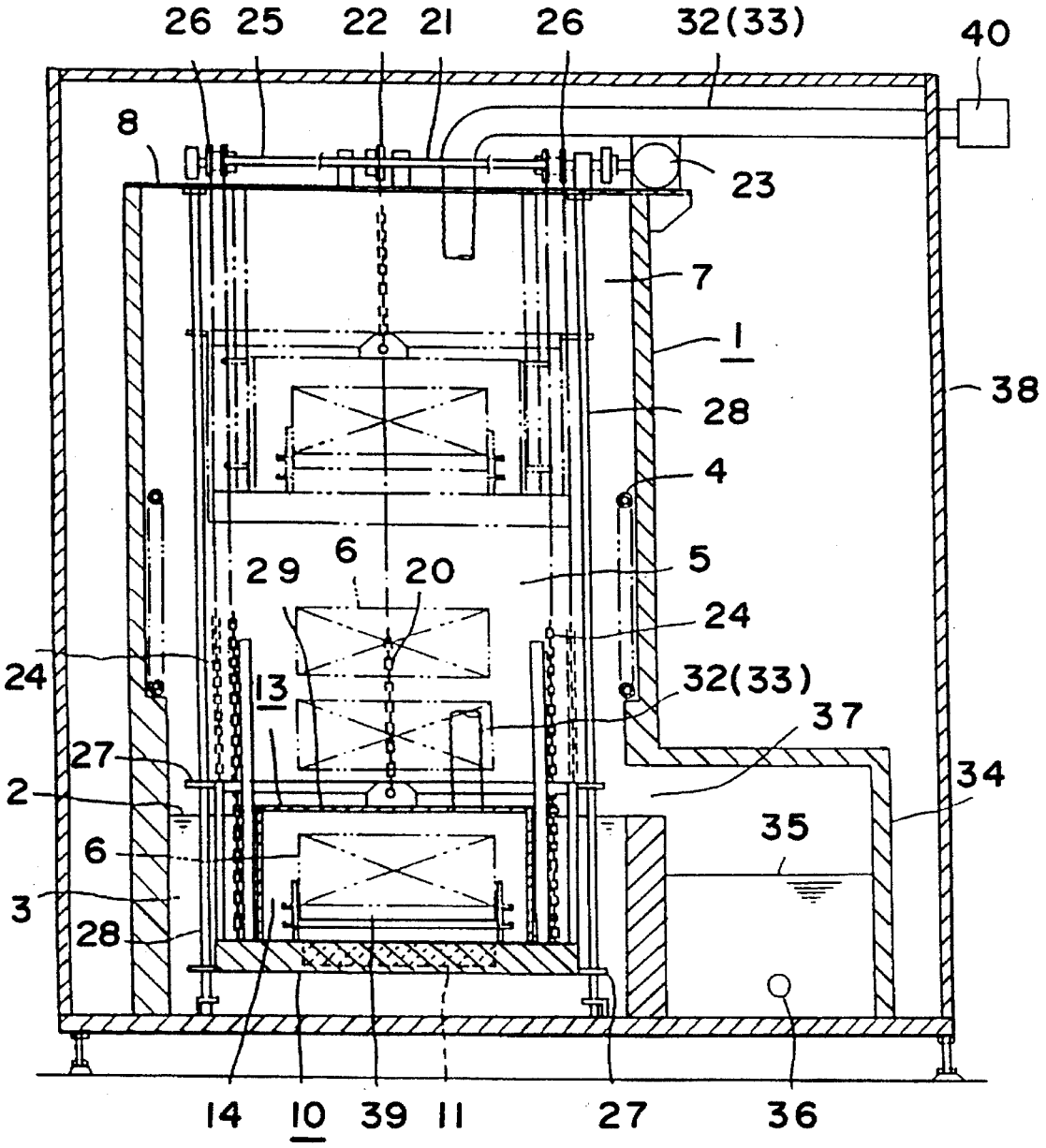
FIG. 1 is a cross-sectional view showing a preferred washing apparatus according to the invention.
Figure 2:
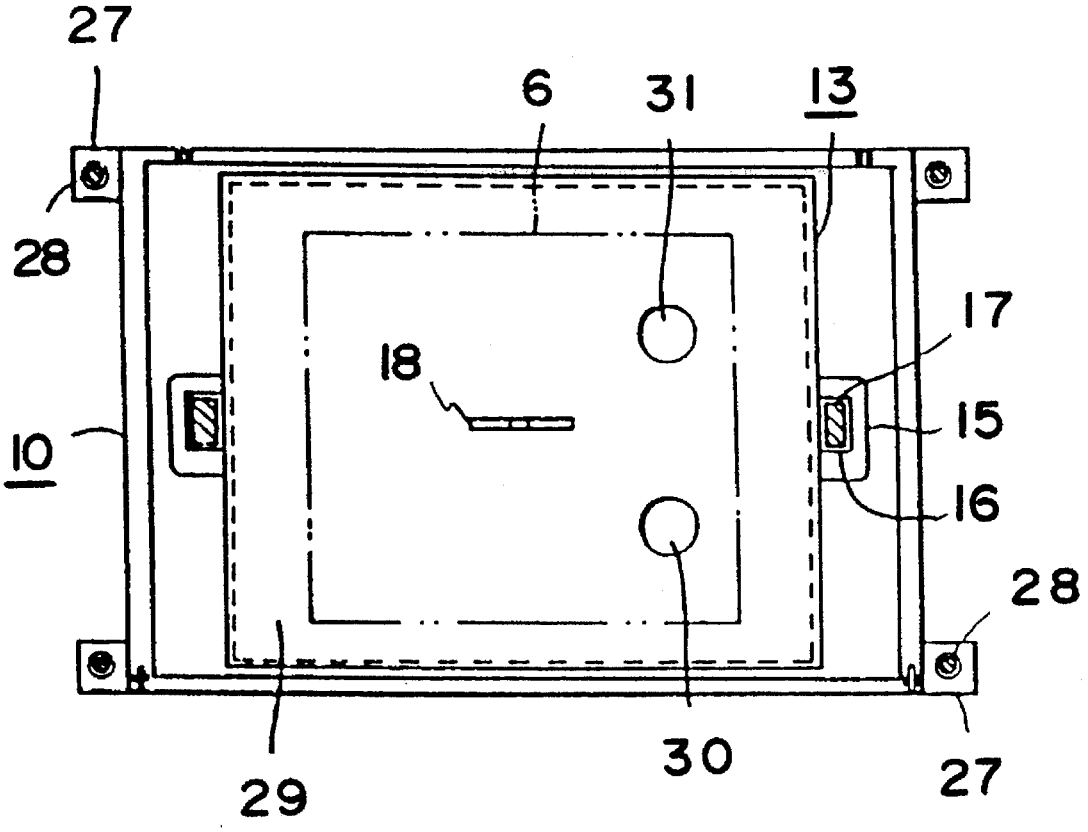
FIG. 2 is an enlarged plan view showing a covering member's portion.
Figure 3:
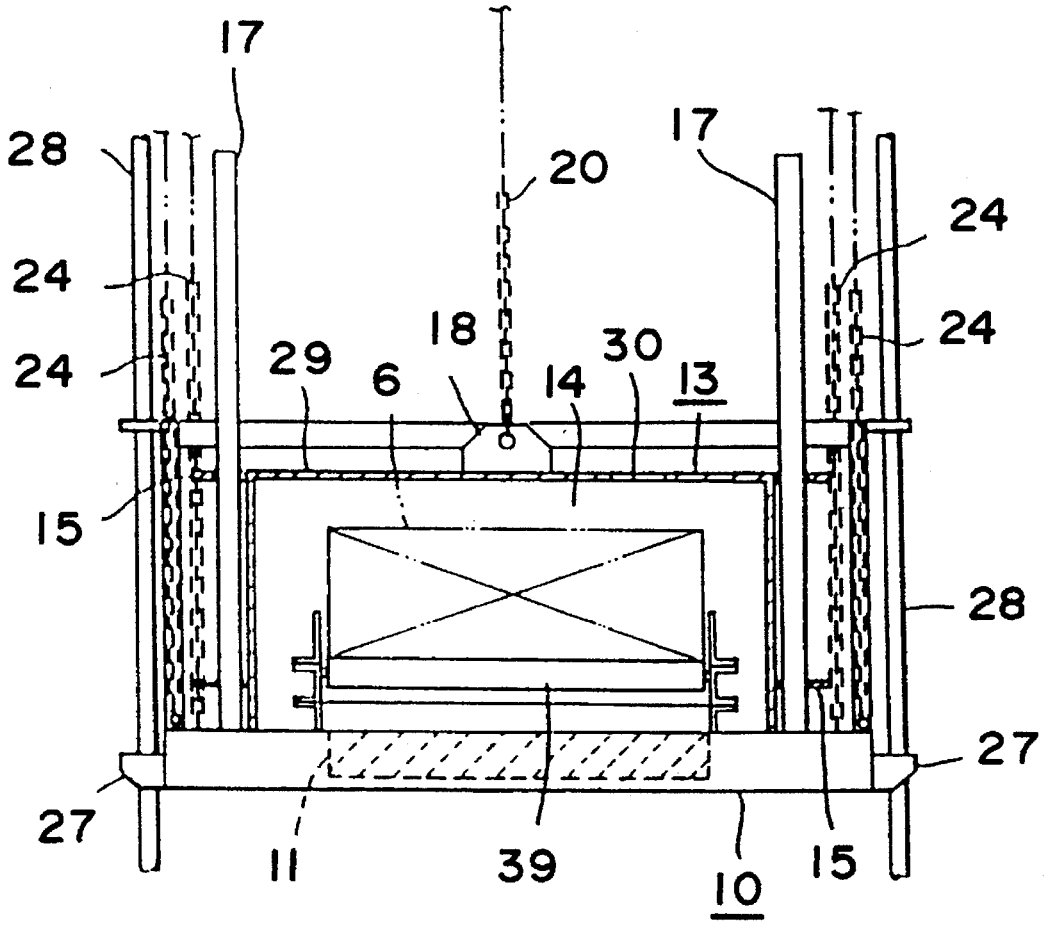
FIG. 3 is an enlarged cross-sectional view showing a washing chamber's part.

Hereinafter, an embodiment according to the invention will be described referring to the drawings. The numeral (1) represents an external bath, which is provided with an immersion washing portion (3) filled with washing liquid (2) located at a lower end of the external bath.

An upper operation chamber (5), at an inner wall surface of which a cooling coil (4) is wound around, is formed at a top of the immersion washing portion (3). Located over the upper operation chamber (5) is a loading chamber (7) for loading and unloading articles (6) to be cleaned. It is to be noted that the loading door of the loading chamber (7) is formed in a front to rear direction, so it is not shown. A top board (8) seals the top end of the loading chamber (7).

A table (10) is inserted inside of the external bath (1) for putting the articles (6) thereon for washing work. The table (10) is formed in a plate shape that does not pass the washing liquid (2) therethrough in a vertical direction and is capable of strongly stirring the washing liquid (2) in the external bath (1), thereby making contacts between the articles (6) and the washing liquid (2) strong, and thereby enabling to obtain an excellent washing effect.

The table (10) is formed with an ultrasonic vibrator (11) on the top face thereof. The washing apparatus can perform ultrasonic washing at the same time to make the contacts between the articles (6) and the washing liquid (2) strong while moving the table (10) up and down in the washing liquid (2), thereby improving its washing effect.

The table (10) is formed with the ultrasonic vibrator (11) on the top face thereof, which is covered with a covering member (13).

The covering member (13) is formed so as to have a cross section in a rectangular U-shape. The lower end of the covering member (13) is mounted so as to be capable of contacting with the top face of the table (10), and a washing chamber (14) for containing the articles (6) therein and washing them is formed in a space inside of the covering member (13).

Formed so as to be protruded on both sides of the outer periphery of the covering member (13) are guiding tongues (15) whose holes (16) slidably engage with guide rails (17). The guide rail (17) has the lower end fixed to the table (10) to make the covering member (13) move up and down without swinging in a lateral direction.

In the covering member (13), an open-and-close chain (20) is connected with an attached metal fitting (18) protruded from the top face of the covering member (13). The open-and-close chain (20) is connected to a drive shaft (21) arranged on the top board (8) of the external bath (1) through a pulley (22). The drive shaft (21) is rotated by a motor (23) secured to an outside of the external bath (1), so that the washing apparatus can elevate the covering member (13) through the open-and-close chain (20) so as to separate the lower end of the covering member (13) from the table (10).

The table (10) is connected to an elevating chain (24), which is connected to a rotary shaft (25) arranged on the top board (8) of the external bath (1) through a pulley (26) to enable the table (10) to move up and down.

The elevating chain (24) and the open-and-close chain (20) are operated by the same motor (23) and formed so as to be operated individually by a switching device not shown.

The table (10) has four guide fittings (27) protruded from respective four corners of the outer periphery thereof. A table guide rail (28) is slidably inserted to each guide fitting (27). These table guide rails (28) are connected to the bottom of the external bath (1) and positioned to be upright, so that the washing apparatus is constituted so that the table (10) never be swung laterally when moved up and down by the elevating chain (24).

The covering member (13) has a connection opening (30) and a drain opening (31), formed at a ceiling (29) thereof. A connection pipe (32) and a draining pipe (33) are connected to the connection opening (30) and the drain opening (31), respectively. The connection pipe (32) is connected to an external mechanism (40) provided in addition to the external bath (1) and required for washing of the articles (6).

The external mechanism can be arbitrarily selected in accordance with the purpose of washing. For example, when the external mechanism (40) is a bath for generating washing vapor, it is possible to supply the washing vapor into the washing chamber (14). In another example, the external mechanism (40) is a vacuum pump and is connected to the other end of the connection pipe (32) to make the washing chamber vacuous, thereby enabling the articles (6) to be vacuum-dried.

The articles (6) can be vapor-washed under a condition that the washing chamber (14) is being depressurized by sealing the table (10) with the covering member (13). In this case, even if a combustible solvent, such as hydrocarbonaceous solvent, terpenic solvent, hydrophilic solvent, silicic solvent, or the like, is used as a solvent, since vapor washing in the depressurized atmosphere is conducted in an extremely thin-air condition, the danger of igniting is extremely low and vapor washing can be conducted safely.

If the vapor washing is conducted in a depressurized atmosphere, vapor is produced at a temperature lower than a temperature at which a solvent is boiled under a normal pressure, and therefore, the articles (6) can be vapor-washed at this lower temperature. As a result, even if the articles (6) are made of materials unbearable against a high temperature, vapor washing can be conducted at a low temperature of 100° C. or below using a solvent having its boiling point of 100° C. or above. Consequently, the washing apparatus can perform the vapor washing freely from restrictions from heat-resistances of the materials of the articles (6).

In the case that the vapor washing is done under a reduced pressure, when supply of the washing vapor is stopped after the completion of the vapor washing, the atmosphere of the reduced pressure sealed with the covering member (13) becomes only a reduced pressure condition in which vapor does not exist. By this reduced pressure, the articles (6) fully and evenly heated through the vapor washing can be vacuum-dried under the reduced pressure, so that the articles (6) can be rapidly dried.

When the washing chamber (14) is sealed after the articles (6) and the washing liquid (2) are introduced into the washing chamber (14) and then the washing chamber (14) is depressurized to a vacuum, the gas contained in the washing liquid (2) in the washing chamber (14) is sucked and eliminated. By this elimination of the gas from the washing liquid (2), ultrasonic vibration can extremely easily transmit across the washing liquid. Therefore, the effect of the ultrasonic washing by the ultrasonic vibrator (11) disposed on the table (10) is considerably improved, so that extremely highly effective ultrasonic washing can be conducted.

A vapor-generating bath (34) is connected to the external bath (1). The vapor-generating bath (34) can generate the vapor by containing a proper solvent (35) inside thereof and by heating the solvent (35) with a heater (36). Provided between the vapor-generating bath (34) and the external bath (1) at an upper side of the immersion washing portion (3) is an introducing opening (37) for the vapor, and the washing apparatus is constituted so that the introducing opening (37) can introduce the vapor into the upper operation chamber (5). It is to be noted that the vapor producing bath (34) is not necessary in the case that washing vapor can be supplied from the external mechanism through the connection pipe (32).

Moreover, the outer periphery of the external bath (1) is covered with a protection casing (38), which is not always required, with a constant space therebetween for preventing vapor of the solvent from leaking to the outside thereof.

Since the washing apparatus is thus constituted, various kinds of washing works can be done for the articles (6). As one of the examples, the table (10) is positioned at the loading chamber (7) of the external bath (1), and the loading door (not shown) of the external bath (1) is opened. The articles (6) are then placed on loading rollers (39) arranged on or at the table (10).

Next, the motor (23) is operated to extend the open-and-close chain (20) and the elevating chain (24) at the same time, so that the table (10) is moved downward to the immersion washing portion (3) disposed at the lower end of the external bath (1) to immerse the table (10) and the articles (6) into the washing liquid (2).

Through a method of operating the ultrasonic vibrator (11) in the immersion washing portion (3) or the like, the washing apparatus does immersion washing of the articles (6). In the immerse washing, the washing apparatus can strongly stir the washing liquid (2) in the external bath (1) at a time that the table (10) is moved up and down since the table (10) is formed in a plate shape that does not pass the washing liquid (2) in the up and down direction while the table (10) is swung up and down as a result that the elevating chain (24) is slightly moved up and down. Therefore, the washing apparatus can make the contacts between the articles (6) and the washing liquid (2) strong to obtain an excellent washing effect.

In addition, the washing apparatus can do the ultrasonic washing simultaneously while making the contacts between the articles (6) and the washing liquid (2) strong by moving the table (10) up and down in the washing liquid (2), since the ultrasonic vibrator (11) is formed on the top face of the table (10), so that the washing apparatus can obtain a higher washing effect.

Furthermore, the washing apparatus may wash the articles (6) or the articles (6) contained in a washing basket while rotating them, with a rotatable rotary mechanism incorporated into the table (10).

Next, the motor (23) is operated to move the table (10) to the upper operation chamber (5) disposed over the immersion washing portion (3) by pulling the elevating chain (24) after the completion of the immersion washing. At the upper operation chamber (5), the articles (6) are vapor-washed by washing vapor produced at the vapor producing bath (34) and introduced through the introducing opening (37). In this case, the table (10) is separated from the covering member (1), the washing apparatus keeps a releasing state.

After the completion of the vapor washing, cooling water is passed through the cooling coil (4) to condense the vapor after the introducing opening (37) is tightly closed. By this condensation of the vapor, the articles (6) are cooled and dried.

In another method, after the covering member (13) is mounted on the table (10) in the upper operation chamber (5) and after the washing chamber (14) is made to be in a sealed condition, a vacuum pump is connected to the other end of the connection pipe (32), thereby forcing the washing chamber (14) to be in a reduced pressure condition and allowing the articles (6) to be dried under the reduced pressure.

In other example in use, a heater (not shown) is previously installed in the upper operation chamber (5). By the operation of the heater, the washing chamber (14) sealed with the covering member (13) can be heated to dry the articles (6) located in the washing chamber (14). In this case, the washing apparatus can do depressurized-drying as well as heated-drying if the washing chamber (14) is made under a reduced pressure, so that the washing apparatus can more rapidly and surely dry the articles (6).

In the embodiment described above, vapor is generated from the vapor-generating bath (34) arranged adjacent to the external bath (1) to conduct vapor washing of the articles (6). However, this is not always required. That is, a small amount of the washing liquid (2) is made to be remained at the table (10) and the articles (6) moved up from the immersion washing portion (3), or another solvent is filled thereto, and then, the table (10) and the articles (6) are heated by a heater (not shown) disposed at an inner wall of the upper operation chamber (5) after sealed with the covering member (13). By this heating, vapor is generated in the washing chamber (14), and the articles (6) are washed with the vapor.

According to the washing apparatus thus constructed, economical disadvantages such that a large amount of the solvent is heated to be evaporated at one time in the vapor-generating bath (34) are eliminated, and evaporation only of a small quantity of the washing liquid (2) remaining in the washing chamber (14) by heating allows vapor washing works to be economical.

Moreover, when the vapor washing is conducted in the washing chamber (14), sealed with the covering member (13), in a reduced pressure condition, the danger of igniting is extremely low even if a combustible solvent, such as hydrocarbonaceous solvent, terpenic solvent, hydrophilic solvent, silicic solvent, or the like, is used as the washing liquid (2), so that this enables the vapor washing to be safe.

When the vapor washing is done at a depressurized atmosphere, vapor can be generated at a lower temperature, and the articles (6) are washed with the vapor using a high boiling point solvent freely from restrictions from heat-resistances of the materials of the articles (6) even if the articles (6) are made of materials unbearable against a high temperature.

When the vapor washing is conducted under a reduced pressure, since the depressurized atmosphere only becomes a depressurized state in which vapor does not exist only after supply of the washing vapor is stopped, the articles (6) evenly heated through the vapor washing can be vacuum-dried under the reduced pressure, so that the articles (6) can be dried rapidly.

Although in the embodiment described above, the covering member (13) can be moved up and down by the open-and-close chain (20), this is not always required. That is, the covering member (13) may be secured at a proper position, such as an upper end of the loading chamber (7), and may cover the table (10) at a time that the table (10) is moved up to contact with the covering member (13), so that the washing chamber (14) is formed by sealing with the covering member (13). In this case, the washing apparatus has an advantage that a mechanism for moving the covering member (13) up and down is unnecessary, but loses an advantage that the washing chamber (14) can be formed at an arbitrary position in the vertical direction of the external bath (1).

Although in the embodiments described above, the table (10), the covering member(13) and whatever are moved in the vertical direction, a plurality of immersion washing portions may be disposed in a lateral direction in the external bath (1), and the table (10), the covering member (13) and whatever can be moved in the lateral direction.

Moreover, although in the embodiments described above, a solvent is used as the washing liquid, a water-soluble detergent can be used, and an arbitrary washing liquid can be selected in accordance with the purpose of washing.

Industrial Applicability

This invention is suitable for washing articles to be cleaned, such as electronic parts, mechanical parts, medical supplies, and the like, and is suitable in the case that a single apparatus readily performs various kinds of washing works different from each other in accordance with the purpose of washing of the articles to be cleaned.

I claim:

1. A washing apparatus comprising a bath, a washing liquid arranged in a lower portion of said bath, a table for receiving articles to be cleaned and a covering member, said covering member and said table are independently movable in a vertical direction within said bath, and said covering member is movable to a position above said table and a position contacting said table for sealing said articles to be cleaned between said covering member and said table at more than one location in said vertical direction.

2. The washing apparatus as set forth in claim 1, further comprising a vapor generating bath and wherein said covering member has an opening connected to said vapor generating bath.

3. The washing apparatus as set forth in claim 2, wherein said table has an ultrasonic vibrator.

4. The washing apparatus as set forth in claim 1, further comprising a vacuum pump and wherein said covering member has an opening connected to said vacuum pump.

5. The washing apparatus as set forth in claim 1, wherein said table is a solid plate and reciprocating vertical movement of said table within said washing liquid strongly stirs said washing liquid about said table and into contact with an article to be cleaned.

6. The washing apparatus as set forth in claim 5, wherein said table has an ultrasonic vibrator.

7. The washing apparatus as set forth in claim 1, wherein said table has an ultrasonic vibrator.

8. The washing apparatus as set forth in claim 1, wherein said lower portion of said external bath is an immersion washing portion, and said external bath includes an operation chamber arranged above said immersion washing portion and a loading chamber for the articles arranged above said operation chamber.

9. A washing apparatus comprising an operation chamber into which articles to be clean can be inserted and removed, a lower portion of said operation chamber containing a washing liquid, a vapor generating bath arranged in said lower portion of said operation chamber, said vapor generating bath containing a vaporizable solvent separated from said washing liquid when in liquid form and communicating with said operation chamber when in vapor form, said vapor generating bath containing a heater for heating said vaporizable solvent and forming a washing vapor therefrom, a table for receiving said articles and means for moving said table in a vertical direction within said operation chamber from a position above said washing liquid into and out of said washing liquid, said table having a plate shape not permitting said washing liquid to pass therethrough, a covering member and means for moving said covering member in a vertical direction within said operation chamber from a position above and away from said table to a position on said table for sealing an article to be cleaned between said covering member and said table, said covering member having a ceiling with a connection opening and a vacuum pump connected to said connection opening, wherein said washing apparatus can operate as follows:

(1) said articles are arranged on said table and said table is moved upward and downward in said washing liquid, (2) said articles are sealed in a washing chamber formed by placing said covering member on said table after said washing liquid is introduced on said table, said washing chamber is depressurized by said vacuum pump, and said articles are vapor washed, and (3) said articles are arranged on said table and said table is arranged above said washing liquid, said cover is arranged above and away from said table, said heater is turned on, and said articles are vapor-washed by said washing vapor from said vapor generating bath.

10. The apparatus of claim 9, wherein after washing of said articles, said table is arranged in a upper portion of said operation chamber, said covering member is placed on said table sealing said articles therein, said vacuum pump is operated and said articles are dried under reduced pressure.

11. A washing apparatus comprising an operation chamber into which articles to be clean can be inserted and removed, a lower portion of said operation chamber containing a washing liquid, a table for receiving said articles and means for moving said table in a vertical direction within said operation chamber from a position above said washing liquid into and out of said washing liquid, said table having a plate shape not permitting said washing liquid to pass therethrough, a covering member and means for moving said covering member in a vertical direction within said operation chamber from a position above and away from said table to a position on said table for sealing an article to be cleaned between said covering member and said table, said covering member having a ceiling with a connection opening and a vapor bath for providing washing vapor connected to said connection opening, wherein said washing apparatus can operate as follows:

(1) said articles are arranged on said table and said table is moved upward and downward in said washing liquid, (2) said table is arranged above said washing liquid, said articles are sealed in a washing chamber formed by placing said covering member on said table, and said washing vapor is introduced into said washing chamber, and said articles are vapor-washed by said washing vapor.

* * * * *